US006431031B1

(12) United States Patent
Hu

(10) Patent No.: US 6,431,031 B1
(45) Date of Patent: Aug. 13, 2002

(54) REVERSIBLE RATCHETING TOOL WITH A SMALLER HEAD

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/464,563

(22) Filed: Dec. 16, 1999

(51) Int. Cl.[7] ..... B25B 13/46

(52) U.S. Cl. ..... 81/63.2; 81/62; 81/63; 81/63.1

(58) Field of Search ..... 81/63.2, 62, 63, 81/63.1

(56) References Cited

U.S. PATENT DOCUMENTS

| | | | | |
|---|---|---|---|---|
| 15,482 | A | 8/1856 | Gilman | 81/63 |
| 810,599 | A | 1/1906 | Ansorge | |
| 841,686 | A | 1/1907 | Hatfield | |
| 893,097 | A | 7/1908 | Reams | |
| 915,446 | A | 3/1909 | Kearnes | |
| 1,033,358 | A | 7/1912 | Turner | |
| 1,194,471 | A | 8/1916 | Boosinger | |
| 1,261,092 | A | 4/1918 | Allen | |
| 1,382,492 | A | 6/1921 | Evans | 81/63 |
| 1,426,127 | A | 8/1922 | Tuttle | |
| 1,614,039 | A | 1/1927 | Mandl | |
| 1,957,462 | A | 5/1934 | Kress | 81/63 |
| 2,317,461 | A | 4/1943 | Jackson | |
| 2,542,241 | A | 2/1951 | Fors | |
| 2,657,604 | A | 11/1953 | Rueb | 81/63.2 |
| 2,701,977 | A | 2/1955 | Stone | |
| 2,764,048 | A | 9/1956 | Thompson | |
| 2,769,360 | A | 11/1956 | Cottrell et al. | |
| 2,800,821 | A | 7/1957 | Fruscella | |
| 2,891,434 | A | 6/1959 | Lozensky | |
| 2,957,377 | A | 10/1960 | Hare | |
| 3,019,682 | A | 2/1962 | Hare | 81/63.2 |
| 3,250,157 | A | 5/1966 | Badger | |
| 3,265,171 | A | 8/1966 | Kilness | 81/63 |
| 3,337,014 | A | 8/1967 | Sandrick | 81/63 |
| 3,393,587 | A | 7/1968 | Jolliff et al. | |
| 3,393,780 | A | 7/1968 | Kilness | 81/63 |
| 3,436,992 | A | 4/1969 | Over et al. | |
| 3,577,816 | A | 5/1971 | Alexander et al. | |
| 3,713,356 | A | 1/1973 | Knudsen | |
| 3,742,788 | A | 7/1973 | Priest | |
| 3,838,614 | A | 10/1974 | O'Donnell | |
| 3,908,487 | A | 9/1975 | Plaw | |
| 4,070,932 | A | 1/1978 | Jeannotte | |

(List continued on next page.)

FOREIGN PATENT DOCUMENTS

| | | |
|---|---|---|
| DE | 921198 | 7/1949 |
| FR | 498276 | 1/1920 |
| GB | 1559093 | 1/1980 |
| GB | 2135226 | 8/1984 |

*Primary Examiner*—Joseph J. Hail, III
*Assistant Examiner*—Willie Berry, Jr.
(74) *Attorney, Agent, or Firm*—Alan Kamrath; Rider, Bennett, Egan & Arundel, LLP

(57) ABSTRACT

A ratcheting tool includes a handle and a head with a compartment. A drive member includes a first end extended beyond the compartment, a second end extended beyond the compartment, and a gear wheel formed between the first end and the second end. The gear wheel is rotatably mounted in the compartment and includes a toothed outer periphery. A pawl is mounted in the compartment and includes a toothed side facing the gear wheel teeth. A ring is mounted in the compartment and around the first end of the drive member. The ring is operably connected to the pawl such that the ring and the pawl are pivotable about a rotational axis of the gear wheel and that the pawl is movable in a radial direction relative to the ring. A reversing plate is mounted to the first end of the drive member and pivotable about the rotational axis of the gear wheel between a first position and a second position. A spring having a small pitch provides transmission between the reversing plate and the pawl for moving the pawl between a first ratcheting position and a second ratcheting position.

24 Claims, 17 Drawing Sheets

U.S. PATENT DOCUMENTS 4,111,077 A 9/1978 Cummings et al.
4,128,025 A 12/1978 Main et al. ..... 81/63
4,274,311 A 6/1981 Ebert
4,277,989 A 7/1981 Tracy
4,277,990 A 7/1981 Hall
4,308,768 A 1/1982 Wagner
4,308,769 A 1/1982 Rantanen
4,328,720 A 5/1982 Shiel
4,336,728 A 6/1982 Diebert
4,406,186 A 9/1983 Gummow
4,420,995 A 12/1983 Roberts
4,485,700 A 12/1984 Colvin
4,488,460 A 12/1984 Ballone et al.
4,520,697 A 6/1985 Moetteli
4,631,988 A 12/1986 Colvin
4,662,251 A 5/1987 Kohal
4,709,600 A 12/1987 Mierbach et al.
4,722,252 A 2/1988 Fulcher et al.
4,722,253 A 2/1988 Chow
4,762,033 A 8/1988 Chow
4,770,072 A 9/1988 Neuhaus ..... 81/63.2
4,796,492 A 1/1989 Liou ..... 81/58.4
4,862,775 A 9/1989 Chow
4,869,138 A * 9/1989 Farris
4,903,554 A 2/1990 Colvin
4,934,220 A 6/1990 Slusar et al.
4,986,147 A 1/1991 Cooper
4,991,468 A 2/1991 Lee
5,012,705 A 5/1991 Chow
5,076,121 A 12/1991 Fosella ..... 81/58.4
5,144,869 A 9/1992 Chow
5,157,994 A 10/1992 Krivec ..... 81/63.2
5,178,047 A 1/1993 Arnold et al. ..... 81/63.2
5,199,330 A 4/1993 Arnold et al.
5,199,335 A 4/1993 Arnold et al.
5,230,262 A 7/1993 Ahlund et al. ..... 81/63.2
5,231,903 A 8/1993 Bockman, Jr.
5,233,891 A 8/1993 Arnold et al. ..... 81/63.2
5,271,300 A 12/1993 Zurbuchen et al.
5,295,422 A 3/1994 Chow
5,392,672 A 2/1995 Larson et al.
5,425,291 A 6/1995 Chang ..... 81/60
5,467,672 A 11/1995 Ashby
5,477,757 A 12/1995 Maresh
5,499,560 A 3/1996 Aeschliman
5,501,124 A 3/1996 Ashby
5,509,333 A 4/1996 Rion
5,533,427 A 7/1996 Chow ..... 81/63.2
5,557,994 A 9/1996 Nakayama
5,595,095 A 1/1997 Hillinger
5,626,061 A 5/1997 Whitley
5,626,062 A 5/1997 Colvin ..... 81/63.2
5,636,557 A 6/1997 Ma
5,709,137 A 1/1998 Blacklock
5,782,147 A 7/1998 Chaconas et al.
5,794,496 A 8/1998 Arnold ..... 81/63.2
5,829,326 A 11/1998 Richner
5,857,390 A 1/1999 Whiteford ..... 81/62
5,873,286 A 2/1999 Van Lenten
5,884,538 A 3/1999 Van Lenten
5,901,620 A 5/1999 Arnold ..... 81/63
5,910,197 A 6/1999 Chaconas
5,911,798 A 6/1999 Arnold
5,913,954 A 6/1999 Arnold et al.
5,927,158 A 7/1999 Lin
5,946,987 A 9/1999 Wei
5,946,989 A 9/1999 Hsieh
5,957,009 A 9/1999 McCann ..... 81/63.2
5,964,129 A 10/1999 Shiao
5,970,552 A 10/1999 Kwiecien et al.
5,979,274 A 11/1999 Hsieh
5,996,453 A 12/1999 Blacklock
6,000,302 A 12/1999 Chiang
6,006,631 A 12/1999 Miner et al.
6,044,731 A * 4/2000 Hsieh
6,065,374 A 5/2000 Taggart ..... 81/63.2
6,134,990 A 10/2000 Ling et al.
6,134,991 A 10/2000 Chaconas
D433,896 S 11/2000 Wei
6,148,695 A 11/2000 Hu
6,152,826 A 11/2000 Profeta et al.
6,161,454 A 12/2000 Chaconas
6,164,167 A * 12/2000 Chen
6,216,563 B1 4/2001 Hsien
6,216,567 B1 4/2001 Hu
6,220,123 B1 * 4/2001 Chen
6,230,591 B1 5/2001 Ling et al.
6,240,813 B1 6/2001 Hyatt
6,257,096 B1 7/2001 Ling
6,260,448 B1 7/2001 Chaconas
6,263,767 B1 7/2001 Hu
6,282,991 B1 9/2001 Hu
6,282,992 B1 9/2001 Hu
6,301,998 B1 10/2001 Hu

* cited by examiner

REVERSIBLE RATCHETING TOOL WITH A SMALLER HEAD

BACKGROUND OF THE INVENTION

1. Field of the Invention

The present invention relates to a reversible ratcheting tool having a smaller head for convenient use in a limited space.

2. Description of the Related Art

U.S. Pat. No. 1,957,462 to Kress issued on May 8, 1934 discloses a ratchet wrench including a ratchet wheel 24 housed in a cylindrical recess 23 in the head 22. A pawl 25 is mounted in a second cylindrical recess 26 in the head 22 for controlling movement of the ratchet wheel 24. The pawl 25 is retained in place by a spring-biased plunger 41. Upon rotation of a thumb-piece 58 connected to the pawl 25, the pawl 25 is movable between two positions and thus provides driving and ratcheting of a socket in opposite directions. The pawl 25 is pivoted through a relatively long distance in the head 22, i.e., the head 22 must be relatively large to allow pivotal movement of the pawl 25. Furthermore, the pawl 25 engages with the teeth of the ratchet wheel 24 by only two teeth, i.e., the wrench is not capable of bearing high torque.

U.S. Pat. No. 4,328,720 to Shiel issued on May 11, 1982 discloses a socket wrench including a drive ring 30, a pawl 50 mounted in a recess 52 in the head 21 of the socket wrench and having two toothed portions 56 and 57, and an external latch handle 53 for controlling position of the pawl 50, thereby optionally causing a desired one of the toothed portions 56 and 57 to engage with a ratcheted outer peripheral portion 48 of the drive ring 30 and thus changing the ratcheting direction. Nevertheless, there are too many components in this socket wrench, and the head 21 is relatively large, as it has to receive the components. Processing and assembly for the components are both troublesome and time-consuming. In addition, transmission between the elements for changing the ratcheting direction is not reliable, as the latch handle 53 does not directly actuate the pawl 50. Furthermore, each toothed portion 56, 57 has only two teeth, i.e., the socket wrench is not capable of bearing high torque.

U.S. Pat. No. 5,626,062 to Colvin issued on May 6, 1997 discloses a ratchet wrench including a drive gear 48 mounted in a head 44 thereof. A reversing pawl 60 is mounted in the head 44 and has teeth 62 for engaging the drive teeth 50 of the drive gear 48 to provide driving and ratcheting of the socket 22 in opposite directions that are reversible by movement of the reversing pawl between two positions under control of a reversing lever 102. The reversing pawl 60 is pivoted through a relatively long distance in the head 44, i.e., the head must be large enough to allow pivotal movement of the reversing pawl 60. Furthermore, the pawl 60 engages with the teeth 50 of the drive gear 48 by only two teeth, i.e., the wrench is not capable of bearing high torque.

U.S. Pat. No. 4,762,033 to Chow issued on Aug. 9, 1988 discloses a ratchet wrench including a drive head 30 with inner ratchet teeth 42. A core assembly 34 is rotatably mounted in the drive head 30 and has a tool-coupling stud 56. Mounted in the core assembly 34 is a pawl 46 that engages with the teeth 42. Upon rotation of a control plate 60, the pawl 46 is movable between two positions and thus provides driving and ratcheting of a socket in opposite directions via transmission of an intercoupling, resilient, spring-like wire 104 that is mounted in the core assembly. The pawl 46 engages with the teeth 42 by about five teeth and thus may bear higher torque. Nevertheless, the user must use both hands to switch the ratcheting direction. In addition, there are too many components in this wrench, and the head must be relatively large for receiving the components and allowing movement of the pawl 46. Processing and assembly for these components are both troublesome and time-consuming. Furthermore, the wire 104 tends to malfunction as a result of fatigue and thus fails to provide the required switching direction.

U.S. Pat. No. 4,520,697 to Moetteli issued on Jun. 4, 1985 discloses a ratchet wrench including a holed head 22' having inner ratchet teeth 30'. Mounted in the head 22' is a drive member 32' with a hexagonal drive portion 36'. Also mounted in the head 22' is a pawl 54' having a first set of ratchet teeth 58' and a second set of ratchet teeth 60' for selectively engaging with the teeth 30'. A reverser plate 70' is mounted on top of the drive member 32' and includes two reverser pins 74' for connection with the pawl 54'. The ratcheting action is reversible by merely moving the reverser pins 74'. Nevertheless, there are too many components in this wrench, and the head is large, as it has to receive the components. In addition, processing and assembly are both troublesome and time-consuming. Furthermore, the pawl 54' engages with the teeth 30' by only two teeth, i.e., the wrench is not capable of bearing high torque.

U.S. Pat. No. 3,337,014 to Sandrick issued on Aug. 22, 1967 discloses a ratchet wrench including a head 10 provided with internal periphery ratchet teeth 15. Mounted in the head 10 is a double-ended pawl 26 that is pivotable by a spring pressed plunger 38. Upon rotation of a finger piece 36, the pawl 26 is movable between two positions and thus provides driving and ratcheting of a socket in opposite directions. Nevertheless, there are too many components in this wrench, and the head is large, as it has to receive the components. In addition, processing and assembly are both troublesome and time-consuming. The pawl 26 engages with the teeth 15 by only three teeth, i.e., the wrench is not capable of bearing high torque. Furthermore, the user must use both hands to switch the ratcheting direction.

U.S. Pat. No. 5,144,869 to Chow issued on Sep. 8, 1992 discloses a ratchet wrench including a handle with two box ends each having a ratchet wheel 12 mounted therein. A pawl 20 is engaged with each ratchet wheel 12. A knob 30 is mounted in a middle of the handle and receives a disc 40 that is connected to each pawl 20 by two resilient members 26. When the knob 30 and the disc 40 are rotated, the first toothed section 22 and the second toothed section 23 of each pawl 20 are caused to engage with the associated ratchet wheel 12 via transmission by the resilient members 26, thereby controlling the torque transmission direction of the ratchet wheel 12. Nevertheless, the resilient plates 26 tend to malfunction as a result of fatigue. In addition, position of each pawl 25 cannot be precisely controlled. The handle structure is weak, as it must be machined to provide a space for receiving the knob 30, the resilient members 26, and the pawls 25. Furthermore, each pawl 25 engages with the ratchet wheel 12 by only two teeth, i.e., the wrench is not capable of bearing high torque.

FIG. 18 of the drawings illustrates a conventional ratcheting tool 10' including a head 11' having a first compartment 121' for receiving a drive member 20' with a ratchet wheel 21', a second compartment 122' for receiving a pawl 30', and a third compartment 123' for receiving a switch block 40'. The pawl 30' includes teeth 31' formed on a first side thereof for engaging with teeth of the ratchet wheel 21'. The switch block 40' includes a first side having two operative sections 416' for selectively bearing against a second side of the pawl 30'. A second side of the switch block 40' includes two arcuate grooves 414'. A thumb piece 42' includes a stem 421' that extends through a hole 13' in the head 11', a vertical hole 413' in the switch block 40', and a hole 71' of a cover 70'. A spring 61' is mounted in a cavity 14' in the web area of the tool for urging a ball 62' to engage with one of the grooves 414'. An elastic ring 50' is wound around a stub 411' on the switch block 40' and includes an engaging end 51' engaged in a hole 32' of the pawl 30'. Upon rotation of the thumb piece 42', the pawl 30' is movable between two positions and thus provides driving and ratcheting of a socket in opposite directions via transmission of the switch block 40' and the elastic ring 50'. The pawl 30' engages with the ratchet wheel teeth by more teeth and thus may bear higher torque. Nevertheless, the pawl 30' has long travel in the head 11', and the head 11' must be relatively large for receiving the ratchet wheel 21', the pawl 30', and the switch block 40' and allowing pivotal movement of the pawl 30' and the switch block 40'. In addition, the elastic ring 50' is required for transmitting the force from the switch block 40' to the pawl 30' so as to change the ratcheting direction. More specifically, position of the pawl 30' cannot be precisely controlled. In addition, the elastic ring 50' tends to malfunction as a result of fatigue.

In conclusion, the above-mentioned conventional ratcheting tools fail to provide high torque operation, as most of the pawls merely engage with the ratchet wheel by at best three or five teeth. The head of the ratcheting tool has to be relatively large for accommodating those components and thus is difficult to be used in a limited space. In addition, the pawl is directly driven by the switch button or reverser plate or like element such that the pawl tends to be disengaged from the ratchet wheel or like element if the switch block is inadvertently impinged. Generally, a skilled user uses a combination wrench, a spanner with two open ends, or a ring spanner for tightening or loosening a fastener in a limited space. Yet, it is found that free rotation of the ratcheting tool during ratcheting is too large (larger than the theoretic value of 5°), as the pawl has long travel.

FIGS. 19 and 20 illustrate another conventional ratcheting tool 100' including a head having a compartment 101' for receiving a drive member with a ratchet wheel 108'. The pawl 102' includes teeth 103' formed on a side thereof for engaging with teeth of the ratchet wheel 108'. A switch block 104' is attached to the pawl 102' via an elastic member 106' and includes a thumb piece 105'. Upon pivotal movement of the thumb piece 105', the pawl 102' is movable between two positions and thus provides driving and ratcheting for a socket in opposite directions via transmission of the pawl 102' and the ratchet wheel 108'. The pawl 102' engages with the ratchet wheel teeth by more teeth and thus may bear higher torque. Nevertheless, pivotal axis for the switch block 104' is not coincident with rotational axis of the ratchet wheel 108'. Namely, the head of the ratcheting tool must be machined to form additional grooves or compartments 107' and 109' (FIG. 19) for accommodating the pawl 102' and the switch block 104'. As a result, the head of the ratcheting tool is relatively large. In addition, the pawl 102' tends to be disengaged from the ratchet wheel 108' if the thumb piece 105' is inadvertently impinged. Thus, the engagement between the pawl 102' and the ratchet wheel 108' is adversely affected.

SUMMARY OF THE INVENTION

It is a primary object of the present invention to provide a reversible ratcheting tool with a small head while providing improved driving torque for convenient use in a limited space.

A ratcheting tool in accordance with the present invention comprises:

a handle;

a head extended from the handle and having a compartment therein;

a drive member including a first end extended beyond the compartment, a second end extended beyond the compartment, and a gear wheel formed between the first end and the second end, the gear wheel being rotatably mounted in the compartment and including an outer periphery with a plurality of first teeth;

a pawl mounted in the compartment and including a first side with a plurality of second teeth facing the first teeth of the gear wheel and a second side facing away from the gear wheel;

a ring mounted in the compartment and around the first end of the drive member, the ring being operably connected to the pawl such that the ring and the pawl are pivotable about a rotational axis of the gear wheel and that the pawl is movable in a radial direction relative to the ring;

a reversing plate mounted to the first end of the drive member and pivotable about the rotational axis of the gear wheel between a first position and a second position;

means for retaining the reversing plate in position; and means for providing transmission between the reversing plate and the pawl for moving the pawl between a first ratcheting position and a second ratcheting position, wherein the second teeth of the pawl are engaged with the first teeth of the gear wheel for ratcheting in a first direction when the pawl is in the first ratcheting position, and wherein the second teeth of the pawl are engaged with the first teeth of the gear wheel for ratcheting in a second direction opposite to the first ratcheting direction when the pawl is in the second ratcheting position.

The head includes a top face with an opening, and the first end of the drive member is extended beyond the opening. The second end of the drive member is a drive column for releasably engaging with a socket. The pawl has a recess in a top thereof and the ring has a tip piece engaged in the recess of the pawl in a manner that the ring and the pawl are pivotable about the rotational axis of the gear wheel and that the pawl is movable in the radial direction relative to the ring without disengaging from the ring.

The reversing plate has a thumb piece projected therefrom for manual operation. The reversing plate includes a hole so as to be pivotally mounted around the first end of the drive member. The first end of the drive member includes an engaging groove. A C-clip is engaged in the engaging groove for retaining the drive member in place. A positioning piece projects radially inward from an inner periphery of the hole of the reversing plate and is engaged in the engaging groove for positioning the reversing plate. The thumb piece of the reversing plate includes a receptacle. The reversing plate includes an arcuate groove communicated with the receptacle. A pin is securely mounted in the arcuate groove in a manner allowing pivotable movement of the reversing plate about the rotating axis of the gear wheel. The retaining means includes a U-shape slide piece with two limbs and an elastic member mounted between the limbs of the slide piece. The slide piece includes a tapered push-face consisting of two faces separated by a tip. The push-face of the slide piece is extended into the arcuate groove of the reversing plate, wherein one of the faces bears against the pin when the reversing plate is in its first position to thereby retain the pawl in its first ratcheting position, and wherein the other face of the slide piece bears against the pin when the reversing plate is in its second position to thereby retain the pawl in its second ratcheting position, the slide piece being slidable relative to the elastic member and biased toward the pin by the elastic member. The reversing plate includes a through-hole, the top face of the head includes a hole, and the ring includes a notch. The gear wheel of the drive member includes an annular groove. The means for providing transmission between the reversing plate and the pawl includes a spring having a small pitch. The spring is extended through the through-hole of the reversing plate, the hole in the top face of the head, and the notch in the ring and retained in the annular groove of the drive member.

The reversing plate has a recessed portion in an upper side thereof for receiving the C-clip. In a modified embodiment of the invention, the recessed portion of the reversing plate has a protrusion and the C-clip has a bulge with a cavity for engaging with the protrusion. The thumb piece of the reversing plate includes a receptacle. The reversing plate includes an arcuate groove communicated with the receptacle. A pin is securely mounted in the arcuate groove in a manner allowing pivotable movement of the reversing plate about the rotating axis of the gear wheel. The retaining means includes a U-shape slide piece with two limbs and an elastic member mounted between the limbs of the slide piece, the slide piece including a tapered push-face consisting of two faces separated by a tip. The push-face of the slide piece being extended into the arcuate groove of the reversing plate, wherein one of the faces bears against the pin when the reversing plate is in its first position to thereby retain the pawl in its first ratcheting position, and wherein the other face of the slide piece bears against the pin when the reversing plate is in its second position to thereby retain the pawl in its second ratcheting position, the slide piece being slidable relative to the elastic member and biased toward the pin by the elastic member. The protrusion of the reversing plate includes a through-hole, the top face of the head includes a hole, and the ring includes a notch. The gear wheel of the drive member includes an annular groove. The means for providing transmission between the reversing plate and the pawl includes a spring having a small pitch. The spring is extended through the through-hole of the reversing plate, the hole in the top face of the head, and the notch in the ring and retained in the annular groove of the drive member.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
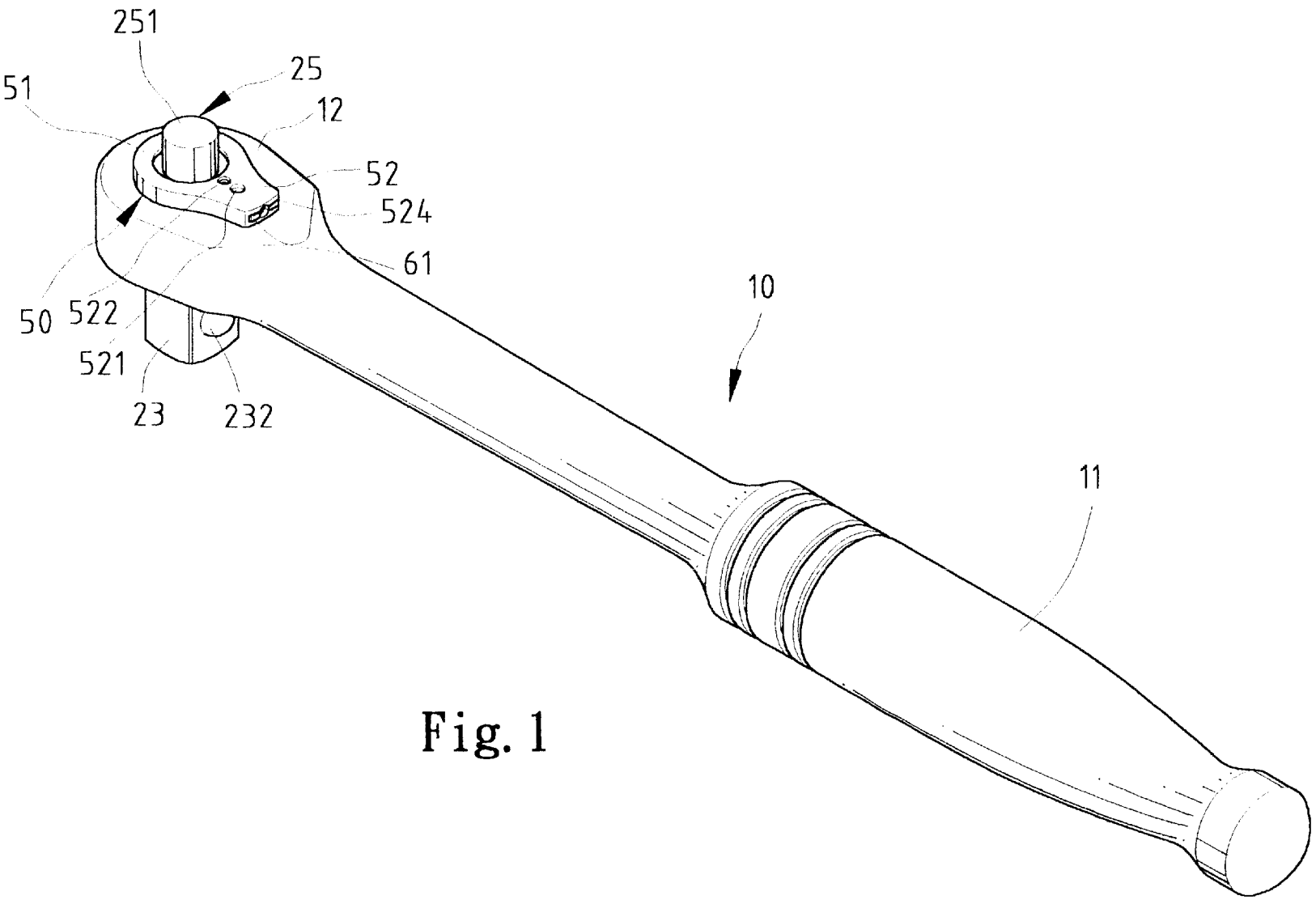
FIG. 1 is a perspective view of a first embodiment of a reversible ratcheting tool in accordance with the present invention.
Figure 2:
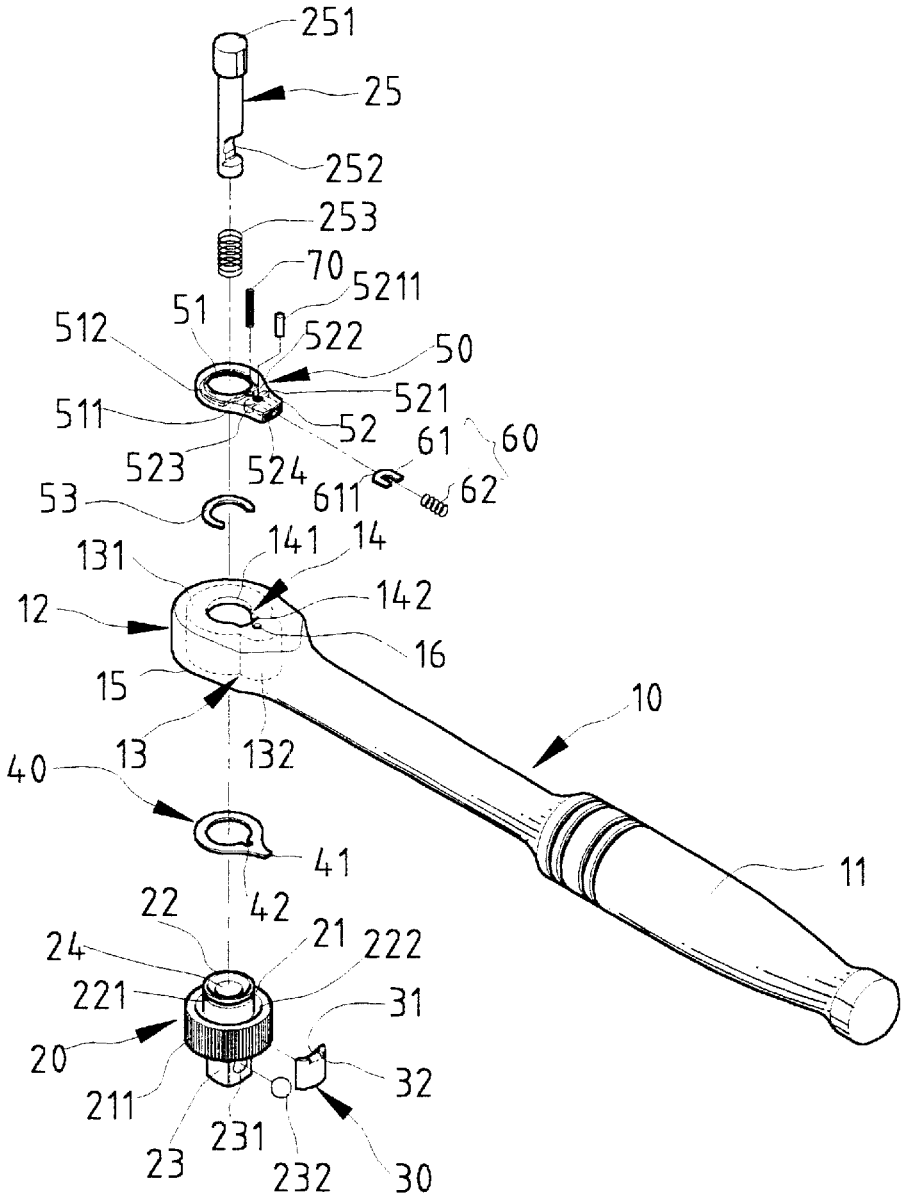
FIG. 2 is an exploded perspective view of the reversible ratcheting tool in FIG. 1.
Figure 5:
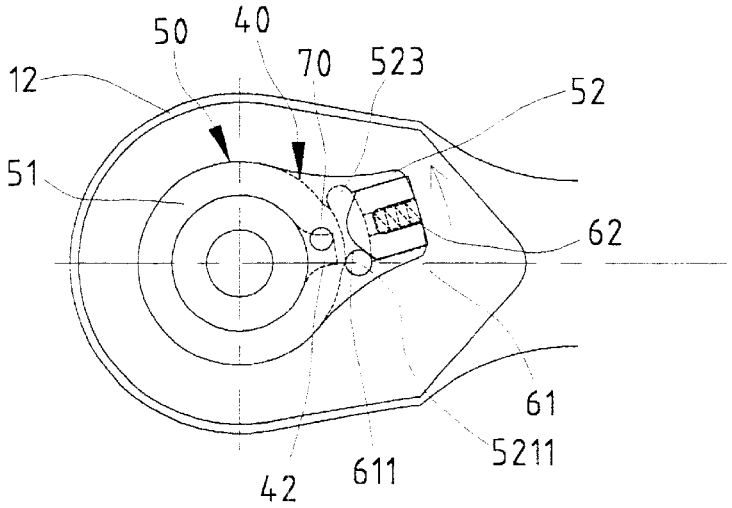
FIG. 5 is a sectional view similar to FIG. 3, wherein the reversible ratcheting tool is in a status allowing clockwise ratcheting.
Figure 6:
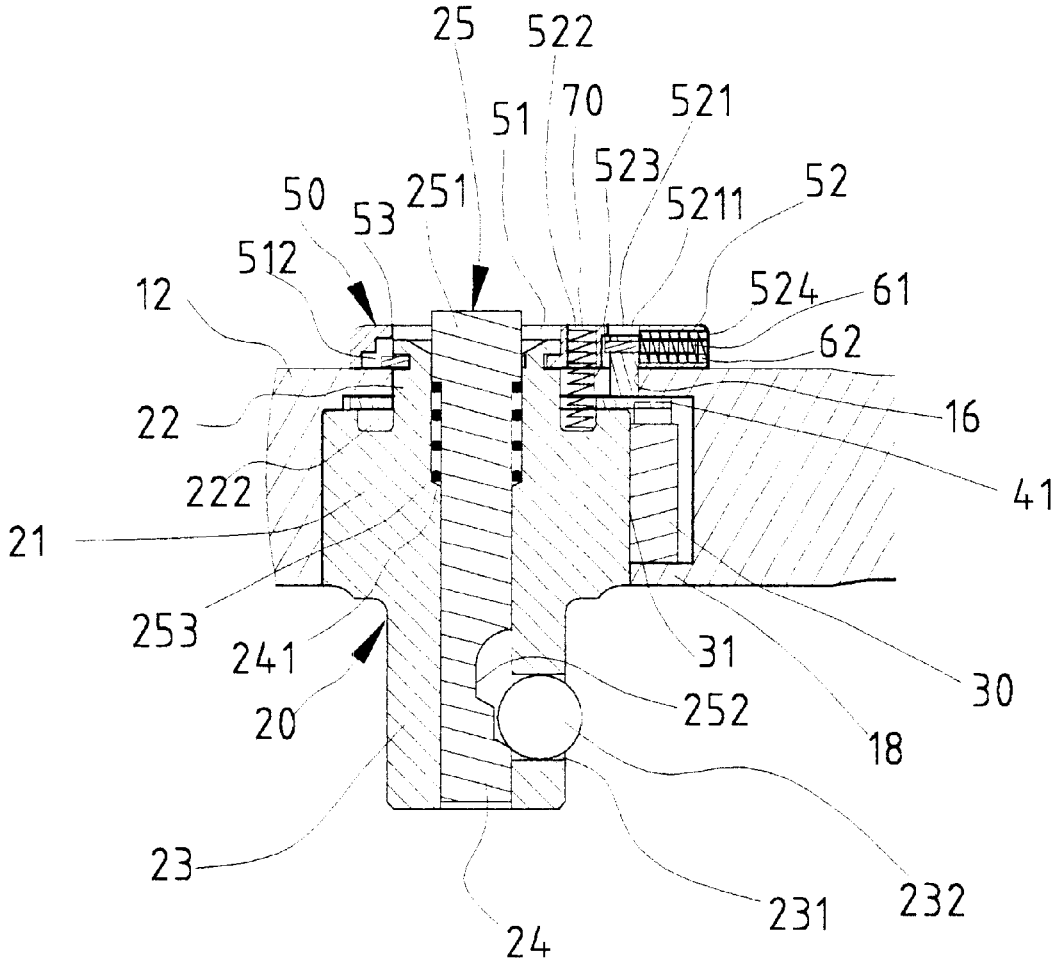
FIG. 6 is a sectional view taken along line 6—6 in FIG. 3.

Referring to FIGS. 1 through 17 and initially to FIGS. 1, 2, and 6, a first embodiment of a ratcheting tool in accordance with the present invention is designated by 10 and has a handle 11 and a head 12 extended from the handle 11. The head 12 is substantially circular and has a minimized volume. The head 12 includes a compartment 13 consisting of a relatively larger first compartment section 131 and a relatively smaller second compartment section 132. A top face (not labeled) of the head 12 includes an opening 14 consisting of a circular opening section 141 that is concentric with the first compartment section 131 and a rectangular opening section 142. The top face of the head 12 further includes a hole 16 adjacent to the opening section 142. Defined in a lower end of the head 12 is a circular hole 15 that is concentric with the first compartment section 131 and has a diameter the same as that of the first compartment section 131. Thus, the lower end of the head 12 is formed with a ledge 18 (FIG. 6) that defines a portion of the second compartment section 132.

Rotatably mounted in the head 12 is a drive member 20 having an upper end 22, a drive column 23 on a lower end thereof, and a gear wheel 21 formed in an intermediate portion thereof. The gear wheel 21 is rotatably received in the first compartment 131 of the head 12 and includes teeth 211 formed on an outer periphery thereof The upper end 22 of the drive member 20 includes an engaging groove 221, and an annular groove 222 is defined in a side of the gear wheel 21. The drive column 23 includes a hole 231 for receiving a ball 232. The drive member 20 further includes a central through-hole 24 with a shoulder portion 241, which will be described later.

Still referring to FIGS. 1, 2, and 6, a pushpin 25 is mounted in the through-hole 24 of the drive member 20 and includes an enlarged upper end 251 for manual pressing. A lower end of the pushpin 25 includes a stepped groove 252 for receiving a portion of the ball 232 when the pushpin 25 is pushed, thereby allowing disengagement of the drive column 23 from a socket (not shown). An elastic member 253 is mounted around the pushpin 25 and attached between the shoulder portion 241 of the through-hole 24 and the enlarged end 251 of the pushpin 25. The elastic member 253 biases the pushpin 25 upward for moving the ball 232 outward to an engaging position for engaging with a socket, which is conventional and therefore not further described. The ball 232 in the engaging position is engaged with the stepped groove 252 to thereby prevent disengagement of the pushpin 25.

A pawl 30 is mounted in the second compartment section 132 and includes an arcuate surface 31 facing the gear wheel teeth 211. The arcuate surface 31 has a plurality of teeth 311 (preferably more than ten teeth) for engaging with the gear wheel teeth 211, thereby providing reliable mesh therebetween. Thus, the pawl/gear wheel arrangement of the ratcheting tool of the invention may bear higher torque. The pawl 30 includes a recess 32 on a top thereof.

Still referring to FIGS. 1, 2, and 6, a ring 40 is pivotally mounted around the upper end 22 of the drive member 20. A tip piece 41 projects outward from the ring 40 and is engaged in the recess 32 of the pawl 30 to move therewith. A notch 42 is defined in an inner periphery of the ring 40 and aligned with the annular groove 222 of the drive member 20.

A reversing plate 50 is mounted around the upper end 22 of the drive member 20 and includes a hole 51 and a thumb piece 52. As illustrated in FIG. 6, the enlarged upper end 251 of the pushpin 25 extends through the circular opening section 141 of the head 12 and beyond the hole 51 of the reversing plate 50 for manual operation. A positioning piece 511 projects radially inward from an inner periphery of the hole 51 of the reversing plate 50 in a portion adjacent to the thumb piece 52. The inner periphery of the hole 51 of the reversing plate 50 further includes a cavity 512 facing the positioning piece 511. A C-clip 53 is mounted around a portion of the engaging groove 221 of the upper end 22 of the drive member 20, thereby retaining the upper end 22 of the drive member 20 to the top face of the head 12. The C-clip 53 is partially accommodated in the cavity 512 of the reversing plate 50. In addition, the positioning piece 511 is extended into the remaining portion of the engaging groove 221 of the drive member 205 Thus, the reversing plate 50 is pivotally mounted to the upper end 22 of the drive member 20. The thumb piece 52 of the reversing plate 50 further includes two through-holes 521 and 522. An arcuate groove 523 is defined in an underside of the thumb piece 52 and communicated with through-hole 521. The thumb piece 52 includes a receptacle 524 that is communicated with the arcuate groove 523.

A retaining means 60 is mounted in the receptacle 524 of the thumb piece 52 and includes a substantially U-shape slide piece 61 and an elastic member 62. The slide piece 61 includes a tapered push-face 611 consisting of two faces (not labeled) separated by a tip (not labeled, see FIG. 2). The elastic member 62 is received between two limbs (not labeled) of the U-shape slide piece 61. In practice, an end face of the receptacle 524 is pressed to form a configuration for preventing disengagement of the elastic member 62 from the receptacle 524 yet allowing movement of the slider piece 61 relative to the elastic member 62.

A pin 5211 is inserted through the through-hole 521 of the thumb piece 52 with a lower end of the pin 5211 extended through the arcuate groove 523 and into the hole 16 of the head 12. Thus, the pin 5211 is retained in the hole 16. As a result, the arcuate groove 523 is movable relative to the pin 5211 during pivotal movement of the reversing plate 50. The push-face 611 of the slide piece 61 may retain the pin 5211 in place. In addition, as the pin 5211 is retained in place and the positioning piece 511 of the reversing plate 50 is engaged in the engaging groove 221 of the drive member 20, the reversing plate 50 is securely yet pivotally engaged with the upper end 22 of the drive member 20.

A transmission member 70 is provided to convert manual pivotal movement of the reversing plate 50 into pivotal movement of the pawl 30 about the rotational axis of the gear wheel 21. In this embodiment, the transmission member 70 is in the form of a spring having a relatively small pitch. The transmission member 70 is extended in the through-hole 522 of the reversing plate 50, the rectangular opening section 142 of the head 12 of the handle 10, and the notch 42 of the ring 40 and then into the annular groove 222 of the drive member 20.

Figure 3:
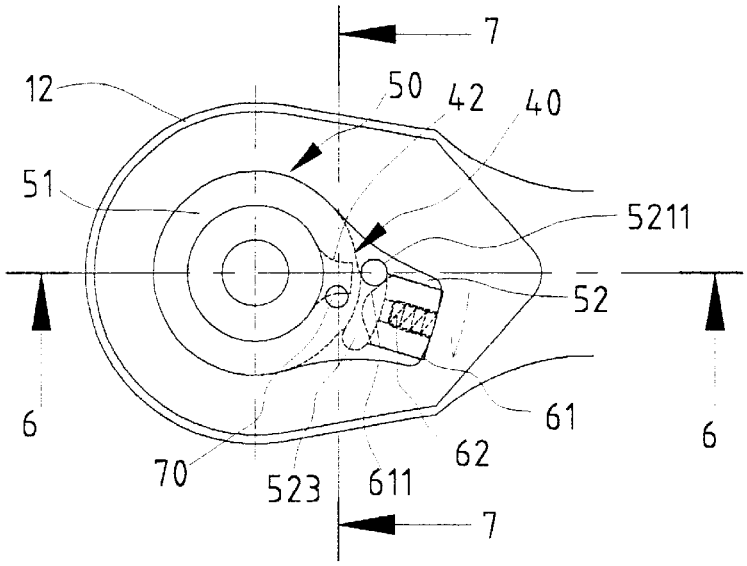
FIG. 3 is a top sectional view, in an enlarged scale, of an end portion of the reversible ratcheting tool in FIG. 1, wherein the ratcheting tool is in a status allowing counterclockwise ratcheting.
Figure 7:
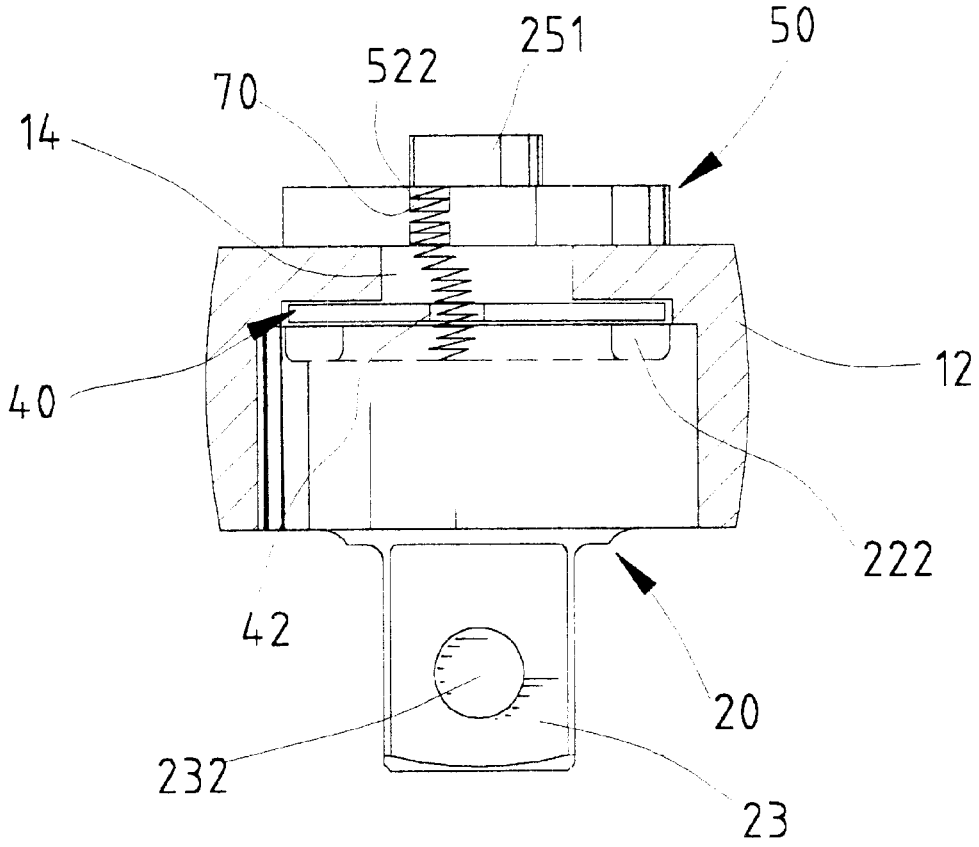
FIG. 7 is a sectional view taken along line 7—7 in FIG. 3.

When the reversing plate 50 is in a position shown in FIG. 3, a face (upper one in FIG. 3) of the push-face 611 of the slide piece 61 bears against the pin 5211 under the action of the elastic member 62. The other side of the pawl 30 facing away from the teeth 31 bears against a wall portion defining the second compartment section 132. Thus, the teeth 31 of the pawl 30 are forced to engage with the teeth 211 of the gear wheel 21 of the drive member 20, best shown in FIG. 6. The ratcheting tool is new in a status for driving a socket (not shown) or the like counterclockwise. The handle of the ratcheting tool may be moved clockwise without disengaging the drive member 20 from the socket. Thus, the ratcheting tool may be used in a relatively small space, as the head 12 of the ratcheting tool is relatively small due to provision of the concentric design of the gear wheel 21 and the reversing plate 50. As illustrated in FIG. 7, the through-hole 522 of the thumb piece 52 is slightly offset from the notch 42 of the ring 40. The transmission member 70 is thus in a zigzag status to provide excellent resiliency in the transverse direction for providing the required transmission.

Figure 4:
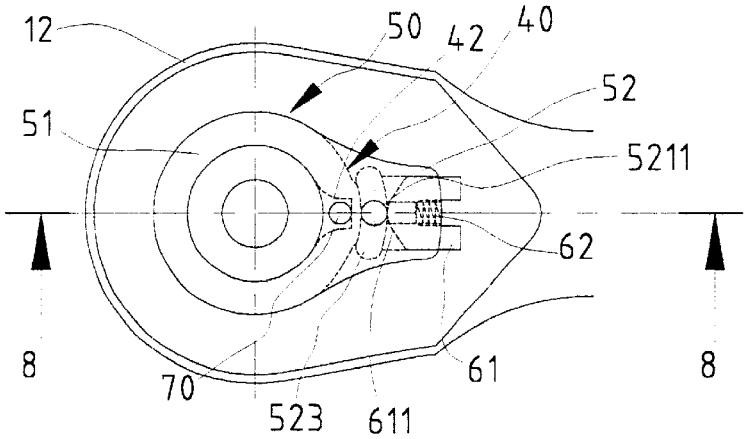
FIG. 4 is a sectional view similar to FIG. 3, wherein the reversible ratcheting tool is in a status allowing free rotation.
Figure 8:
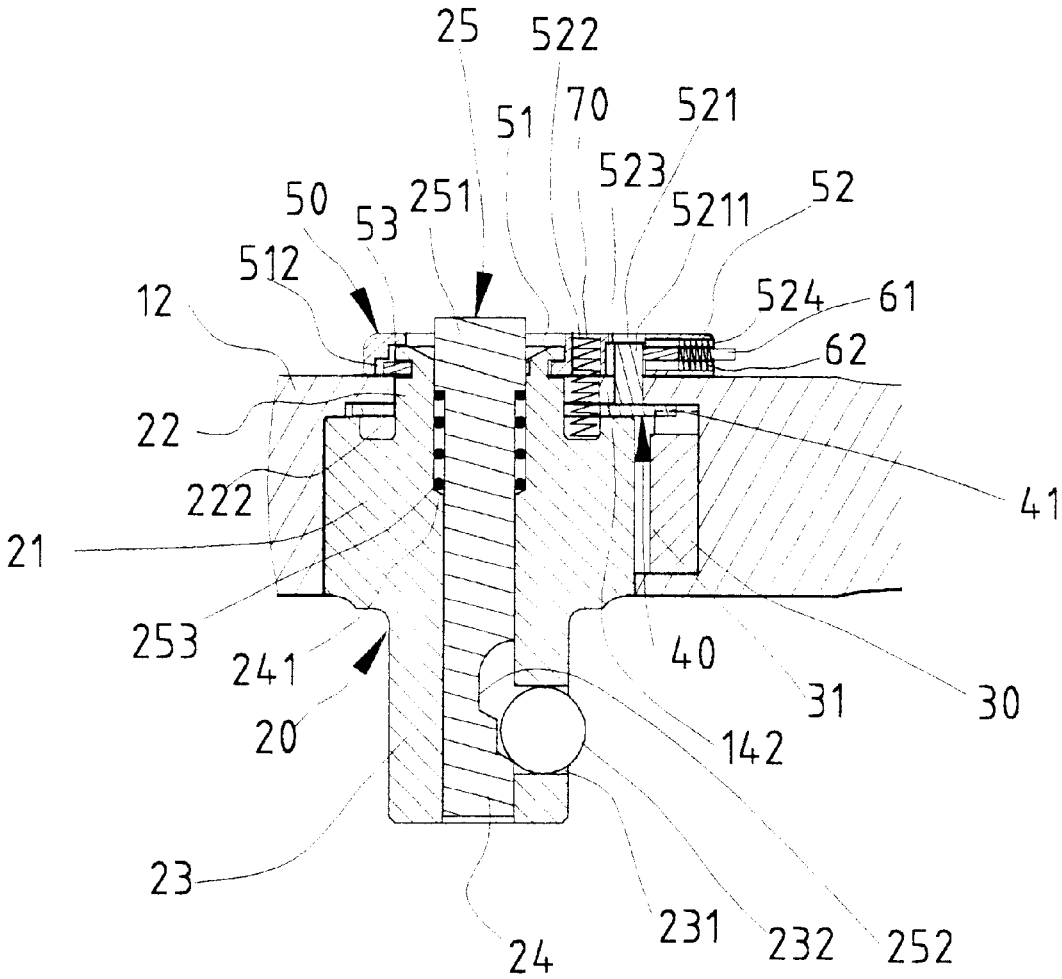
FIG. 8 is a sectional view taken along line 8—8 in FIG. 4.

When the reversing plate 50 is moved to a position shown in FIG. 4, the tip of the pushface 611 of the slide piece 61 bears against the pin 5211 under the action of the elastic member 62. The ring 40 is also pivoted via transmission of the transmission member 70. The pawl 30 is moved away from the gear wheel 21, as the tip piece 41 of the ring 40 is engaged in the recess 32 on the top face of the pawl 30. Thus, the pawl 30 is moved to a middle portion of the second compartment section 132 and thus disengaged from the teeth 211 of the gear wheel 21, as shown in FIG. 8. As a result, the ratcheting tool is incapable of driving the socket.

When the reversing plate 50 is moved to a position shown in FIG. 5 by manually pushing the thumb piece 52, the slide piece 61 is moved away from the drive member 20 and compresses the elastic member 62. Thus, the pin 5211 may slide over the push-face 611 of the slide piece 61 to the other face of the push-face 611. The other side of the pawl 30 facing away from the teeth 311 bears against another portion defining the second compartment section 132. Thus, the teeth 311 of the pawl 30 are forced to reengage with the teeth 211 of the gear wheel 21 of the drive member 20 (see FIG.

6). The ratcheting tool is now in a status for driving the socket clockwise. It is appreciated that the pawl 30 is pivoted during pivotal movement of the thumb piece 52 via transmission of the transmission member 70 and the ring 40 that engages with the pawl 30.

It is appreciated that the pawl 30 engages with the gear wheel 21 by at least ten (10) teeth and thus may bear higher torque during ratcheting. It is noted that the push-face 611 of the slide piece 61, under the action of the elastic member 62, retains the ring 40 as well as the pawl 30 in place to provide reliable ratcheting. Yet, the tip piece 41 of the ring 40 and the recess 32 of the pawl 30 are configured to allow the pawl 30 to be moved away from the gear wheel 21 in a radial direction during non-driving rotation of the handle. Accordingly, the user must apply a relatively larger force to switch the reversing plate 50, yet this also prevents inadvertent impingement to the thumb piece 52 that may cause undesired movement of the pawl 30.

Figure 9:
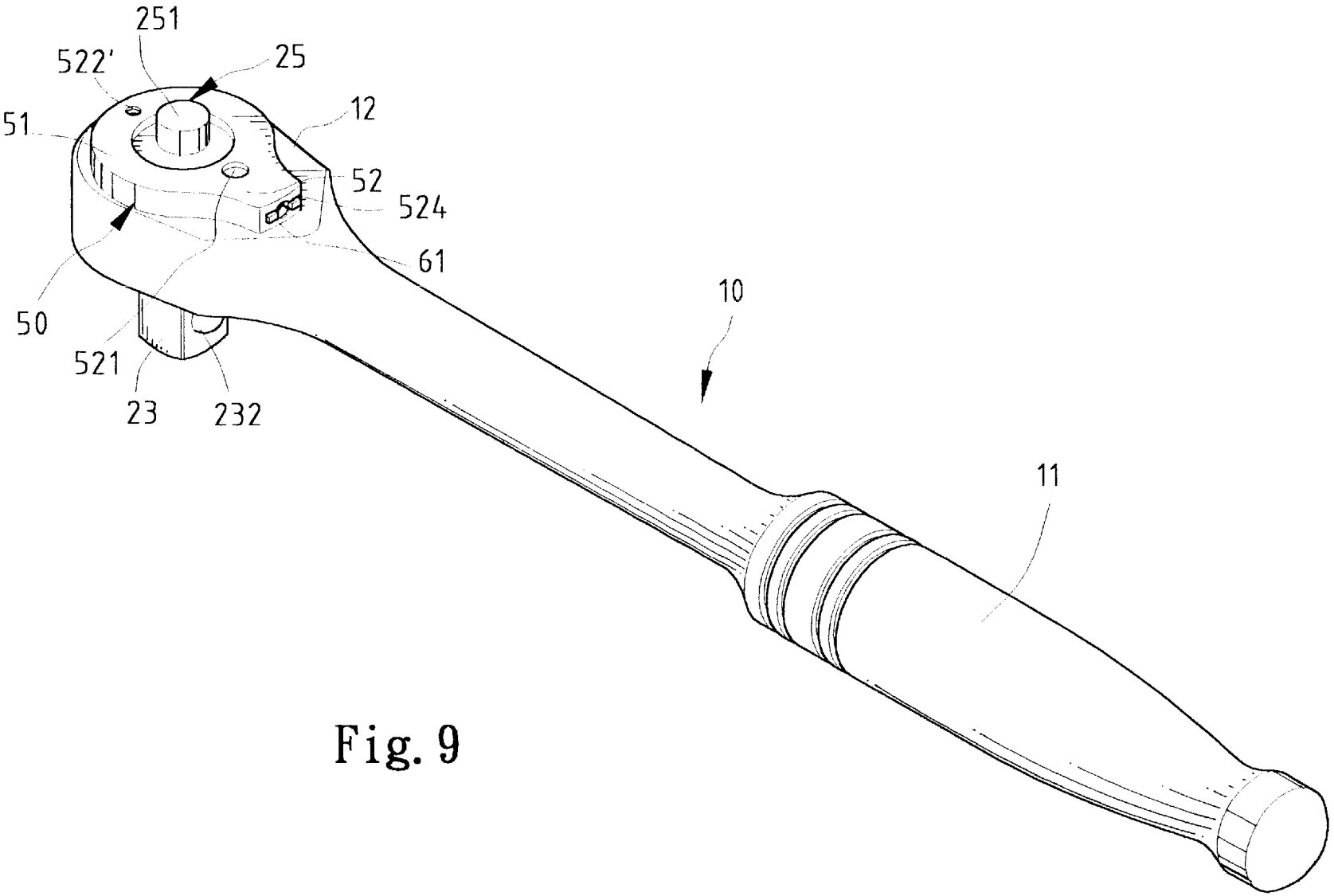
FIG. 9 is a perspective view of a second embodiment of the reversible ratcheting tool in accordance with the present invention.
Figure 10:
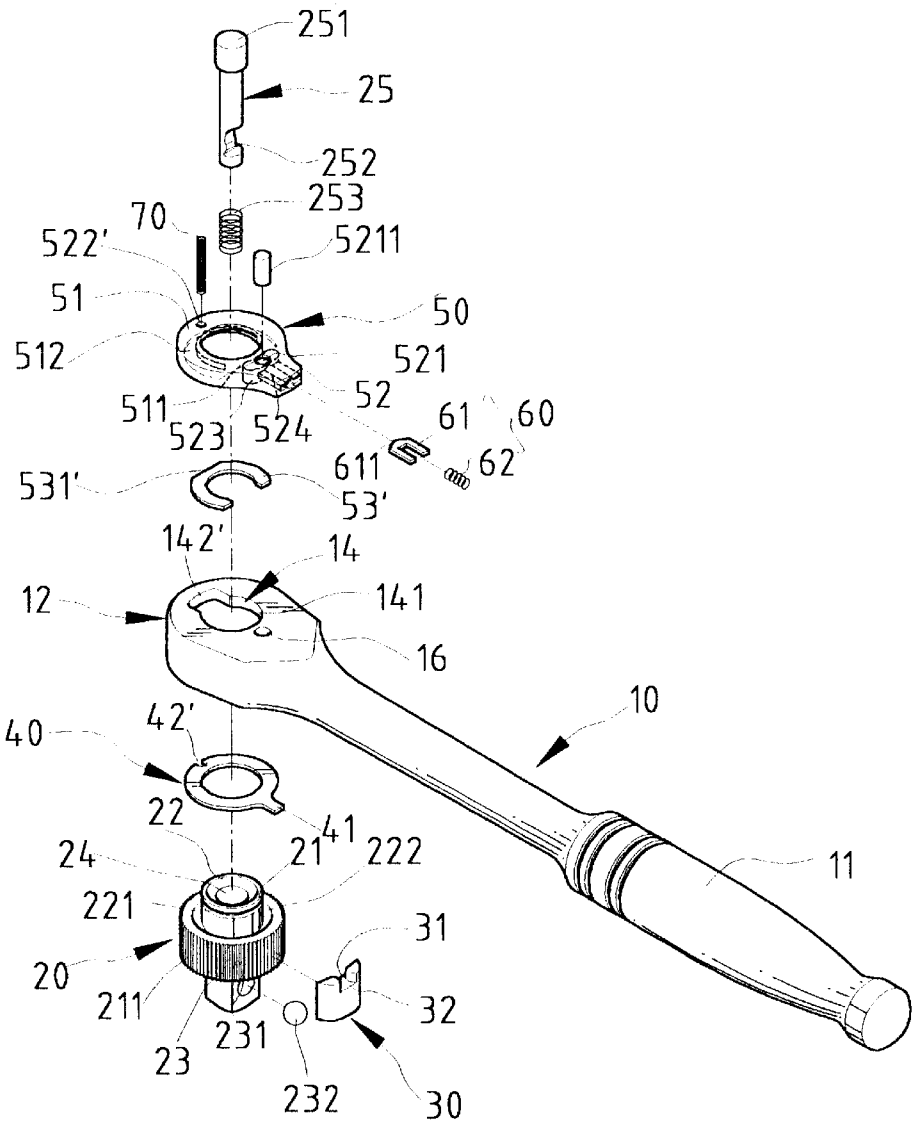
FIG. 10 is an exploded perspective view of the reversible ratcheting tool in FIG. 9.
Figure 11:
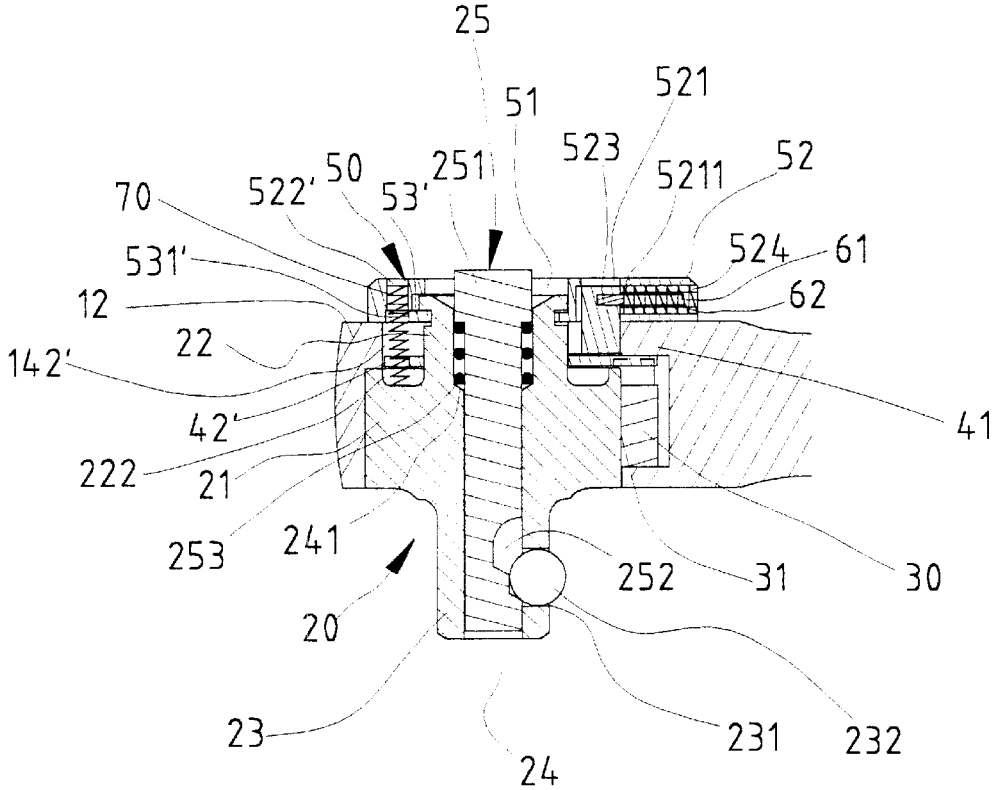
FIG. 11 is a sectional view, similar to FIG. 6, of an end portion of the reversible ratcheting tool in FIG. 9.

FIGS. 9 through 11 illustrate a modified embodiment of the ratcheting tool in accordance with the present invention, in which the transmission member 70 is arranged in a different location. In this embodiment, the rectangular opening section 142' is near the peripheral edge of the head 12. The notch 42' of the ring 40 is defined in an outer periphery of the ring 40. The through-hole 522' of the reversing plate 50 is located opposite to the other through-hole 521. The transmission member 70 is extended through the through-hole 522', the rectangular opening section 142', and the notch 42' and into the annular groove 222 of the drive member 20 to provide a transmission medium between the reversing plate 50 and the pawl 30. The C-clip 53' has a rectilinear face 531' for not interfering with movement of the transmission member 70.

Figure 12:
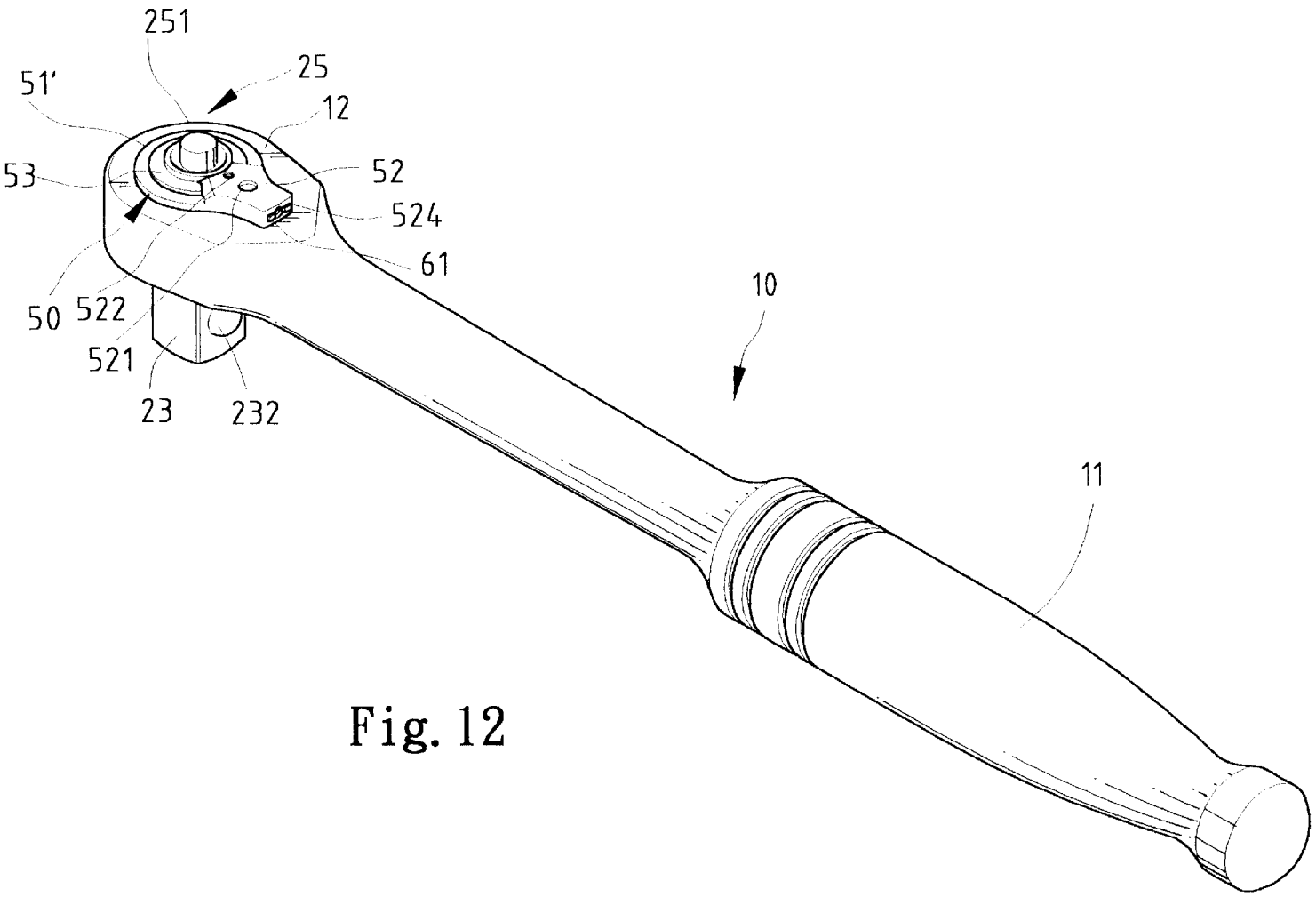
FIG. 12 is a perspective view of a third embodiment of the reversible ratcheting tool in accordance with the present invention.
Figure 13:
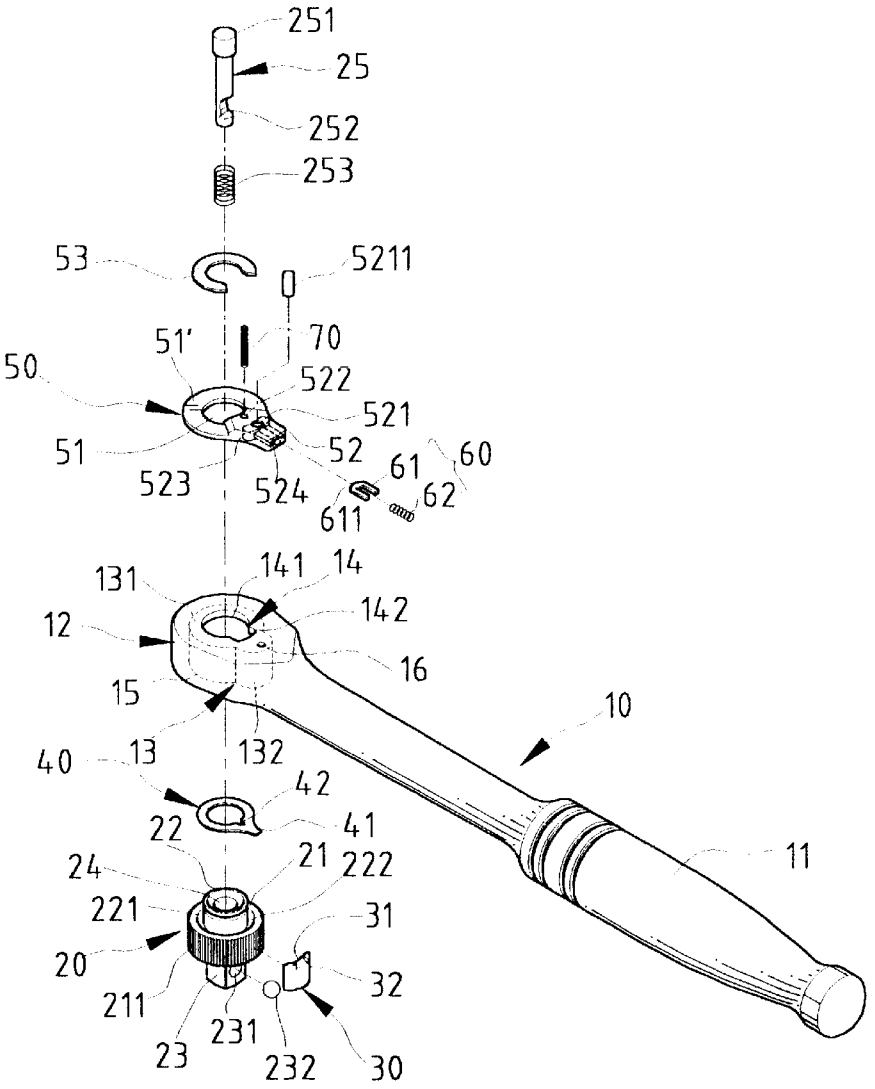
FIG. 13 is an exploded perspective view of the reversible ratcheting tool in FIG. 12.
Figure 14:
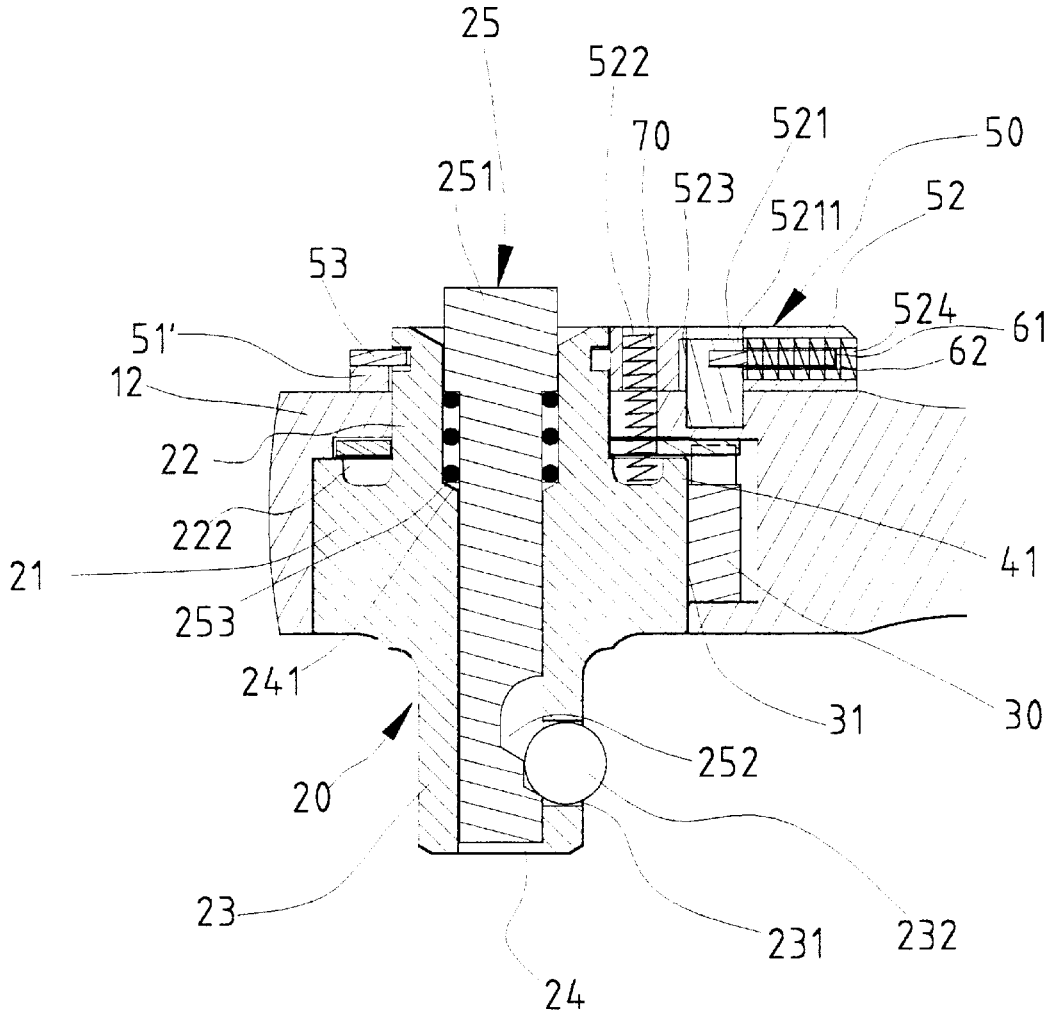
FIG. 14 is a sectional view, similar to FIG. 6, of an end portion of the reversible ratcheting tool in FIG. 12.

FIGS. 12 through 14 illustrate another modified embodiment of the ratcheting tool in accordance with the present invention. In this embodiment, a periphery defining the hole 51 of the reversing plate 50 has a recessed portion 51' in an upper side thereof for mounting the C-clip 53. Namely, the C-clip 53 in this embodiment is mounted on top of the reversing plate 50 rather than the underside of the reversing plate 50 in the above two embodiments.

Figure 15:
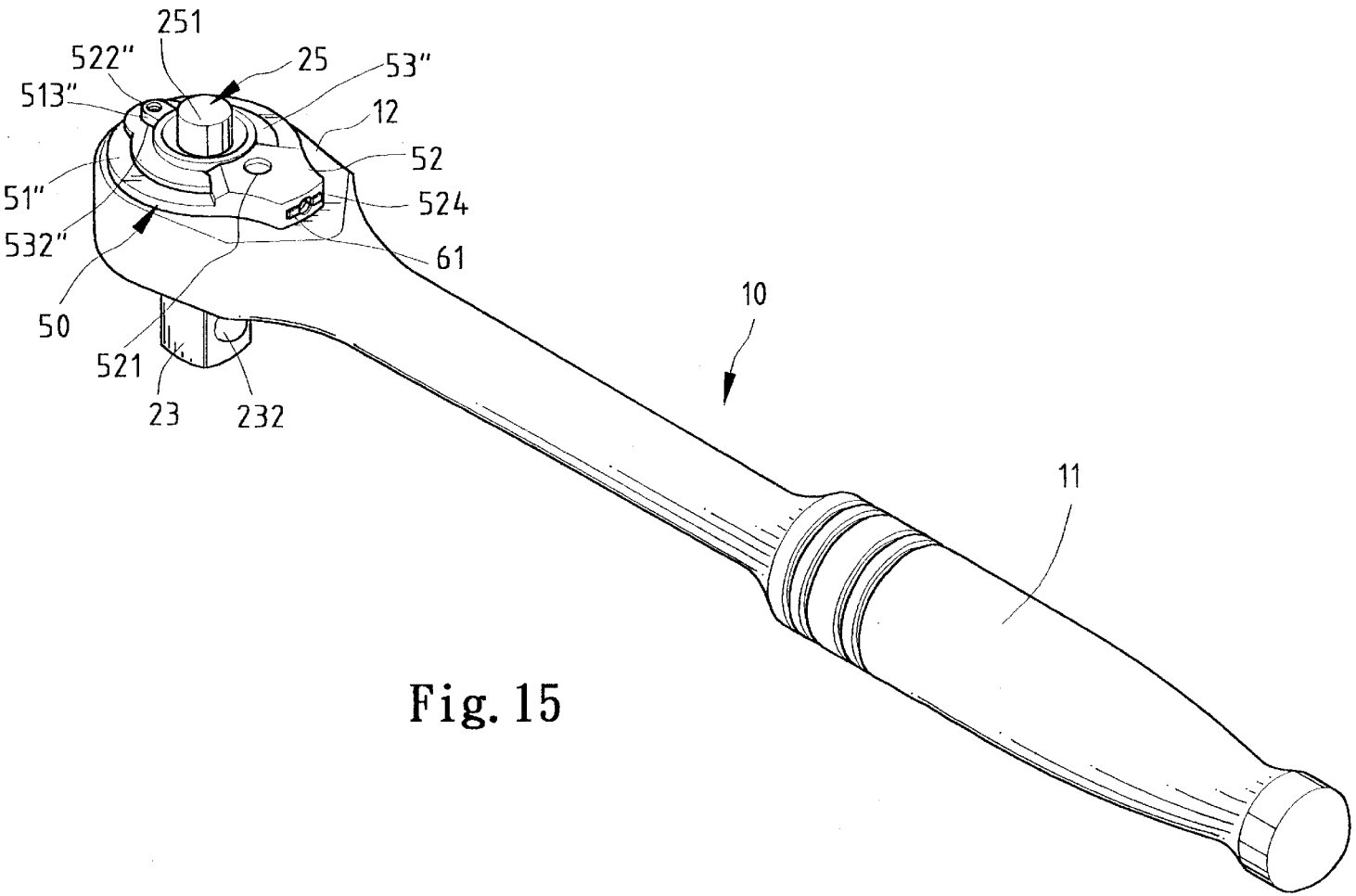
FIG. 15 is a perspective view of a fourth embodiment of the reversible ratcheting tool in accordance with the present invention.
Figure 16:
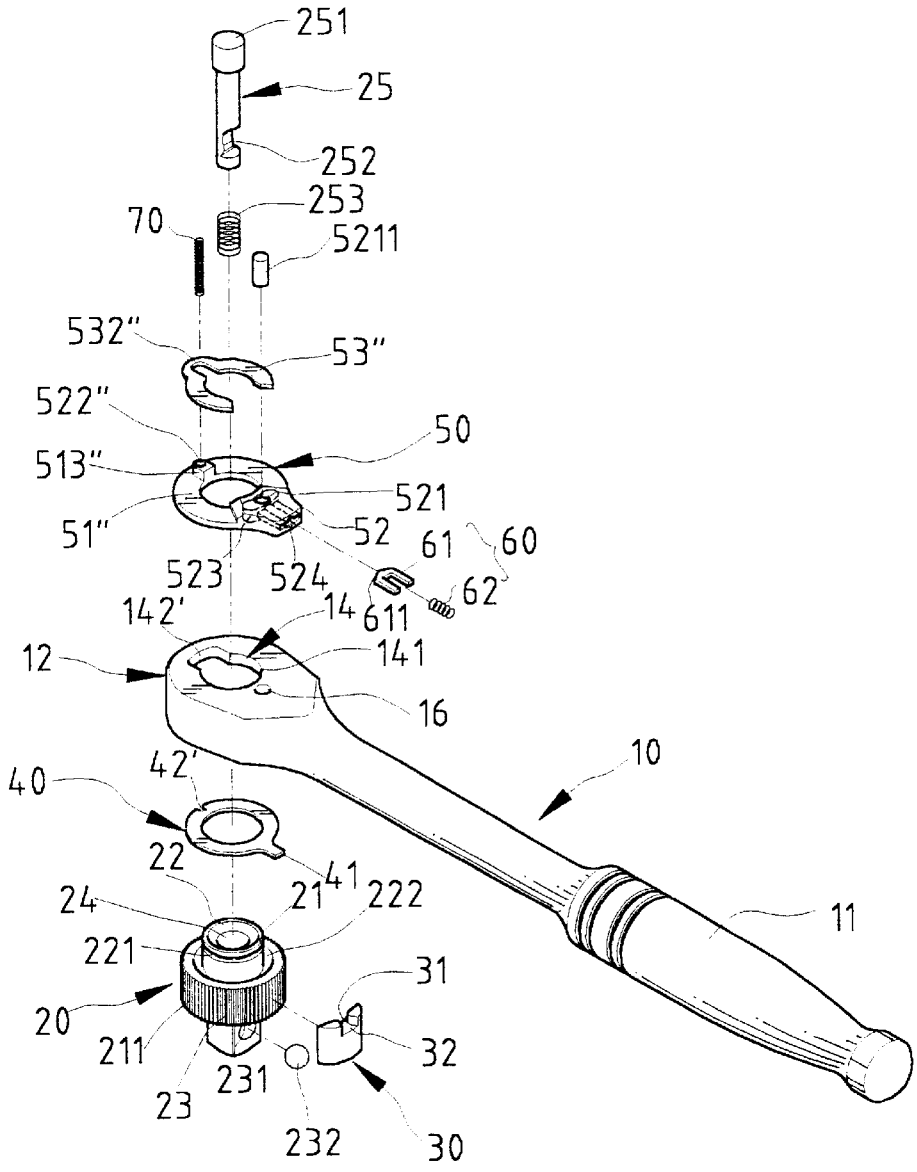
FIG. 16 is an exploded perspective view of the reversible ratcheting tool in FIG. 15.
Figure 17:
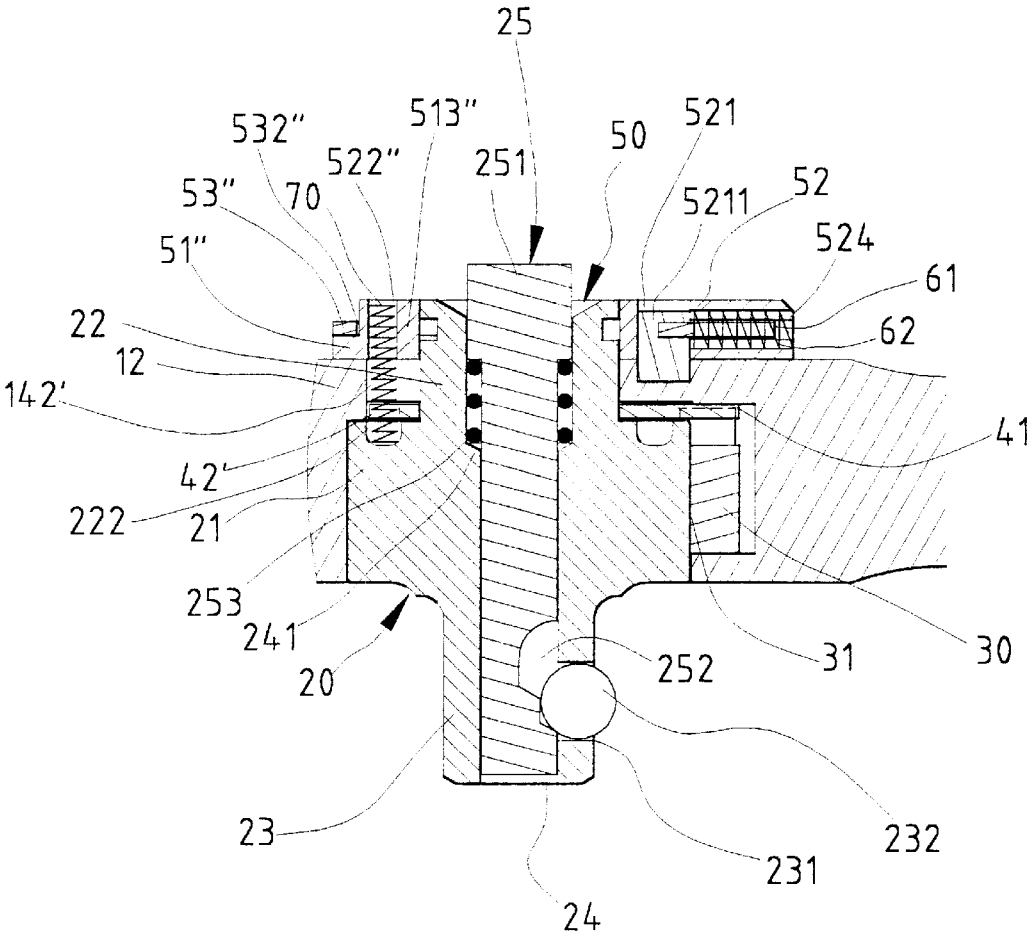
FIG. 17 is a sectional view, similar to FIG. 6, of an end portion of the reversible ratcheting tool in FIG. 15.
Figure 18:
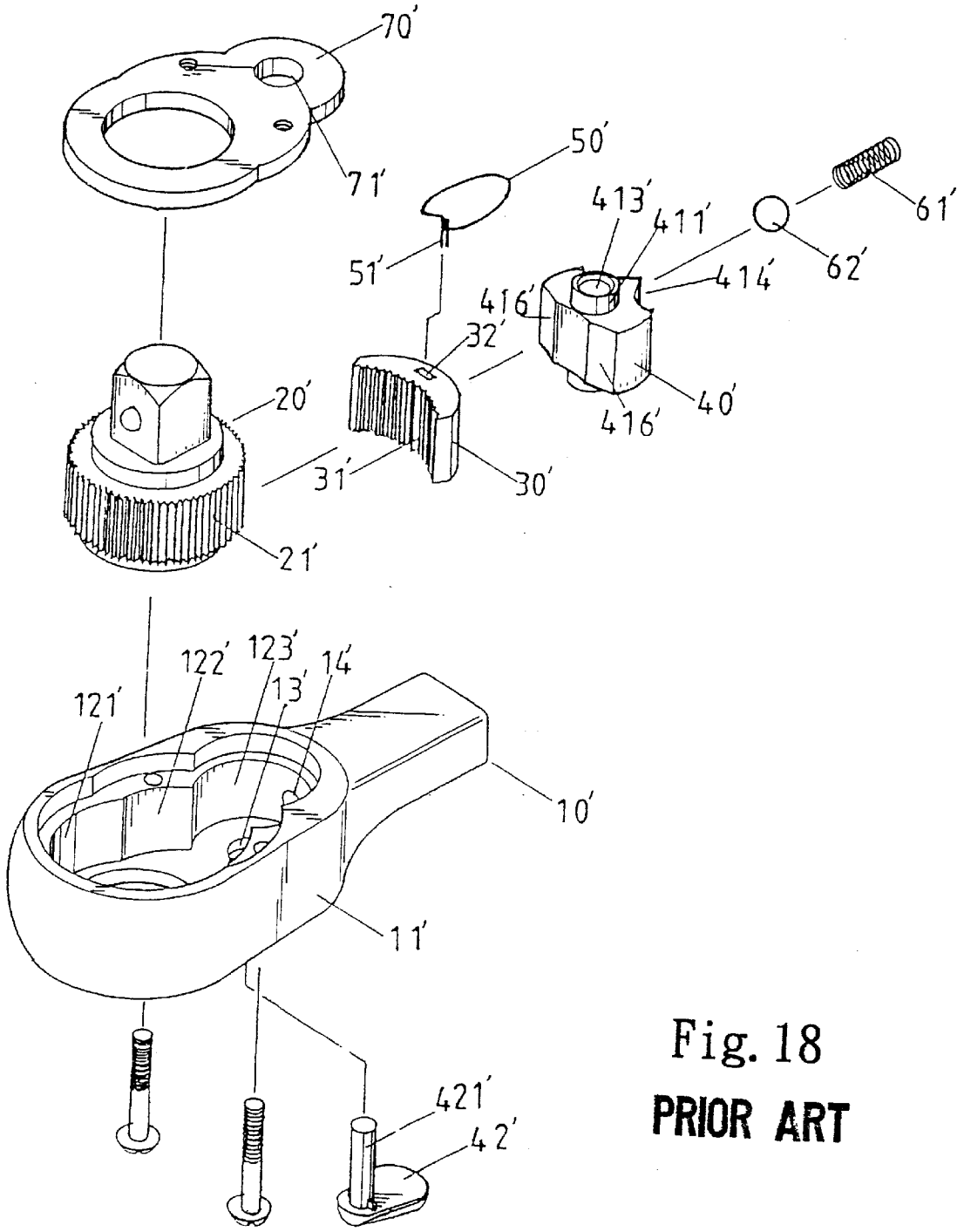
Fig. 18 PRIOR ART
FIG. 18 is an exploded perspective view of a conventional ratcheting tool.
Figure 19:
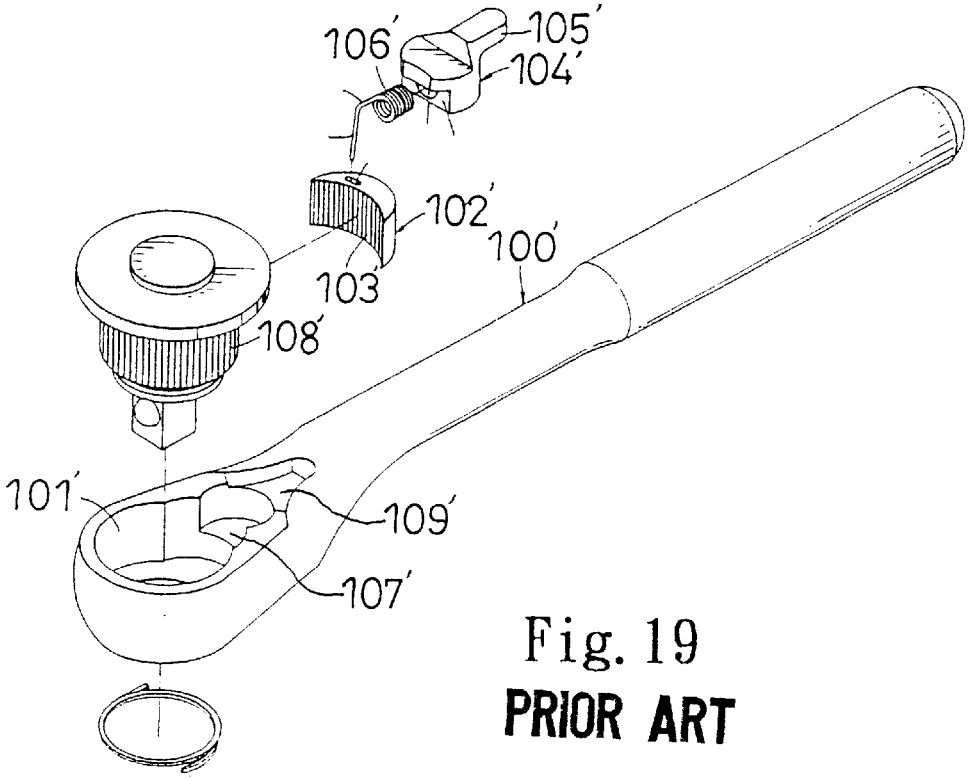
Fig. 19 PRIOR ART
FIG. 19 is an exploded perspective view of another conventional ratcheting tool.
Figure 20:
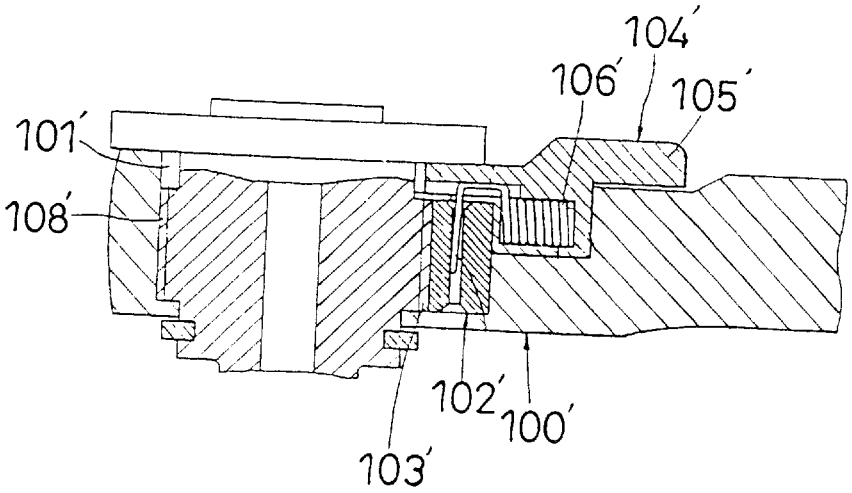
Fig. 20 PRIOR ART
FIG. 20 is a sectional view of an end portion of the conventional ratcheting tool in FIG. 19.

FIGS. 15 through 17 illustrate a further modified embodiment of the ratcheting tool in accordance with the present invention modified from the embodiment illustrated in FIGS. 12 through 14. In this embodiment, the recessed portion (now designated by 51") of the reversing plate 50 has a protrusion 513". In addition, the C-Clip (now designated by 53") has a bulge 532" with a cavity (not labeled) for receiving the protrusion 513", thereby providing secure engagement between the C-clip 53" and the reversing plate 50. The transmission member 70 is also arranged in a location similar to that disclosed in the embodiment illustrated in FIGS. 9 through 11. Namely, the rectangular opening section 142' is near the peripheral edge of the head 12. The notch 42' of the ring 40 is defined in an outer periphery of the ring 40. The through-hole 522" of the reversing plate 50 is defined in the protrusion 513". The transmission member 70 is extended through the through-hole 522", the rectangular opening section 142', and the notch 42' and into the annular groove 222 of the drive member 20 to provide a transmission medium between the reversing plate 50 and the pawl 30.

According to the above description, it is appreciated that the ratcheting tool in accordance with the present invention may bear much higher torque and has minimized head size that is very useful when operating in a limited space. In addition, the ratcheting direction can be changed by easy operation of the reversing plate. The arrangement for achieving the ratcheting direction switching is simple yet requires a relatively larger force to prevent inadvertent switching.

Although the invention has been explained in relation to its preferred embodiment, it is to be understood that many other possible modifications and variations can be made without departing from the spirit and scope of the invention as hereinafter claimed.

What is claimed is:

1. A ratcheting tool comprising:

a handle;

a head extended from the handle and having a compartment therein;

a drive member including a first end, a second end, and a gear wheel formed between the first end and the second end, with the gear wheel being rotatably mounted in the compartment and including an outer periphery with a plurality of first teeth, with the first end of the drive member including an engaging groove;

a pawl mounted in the compartment and including a first side with a plurality of second teeth facing the first teeth of the gear wheel and a second side facing away from the gear wheel;

a reversing plate including a hole so as to be pivotally mounted to the first end of the drive member and pivotable about the rotational axis of the gear wheel between a first position and a second position;

a C-clip engaged in the engaging groove for retaining the drive member in place; and a positioning piece projecting radially inward from an inner periphery of the hole of the reversing plate and being engaged in the engaging groove for positioning the reversing plate, with pivotable movement of the reversing plate between the first position and the second position being transmitted to the pawl for moving the pawl between a first ratcheting position and a second ratcheting position, wherein the second teeth of the pawl are engaged with the first teeth of the gear wheel for ratcheting in a first direction when the pawl is in the first ratcheting position, and wherein the second teeth of the pawl are engaged with the first teeth of the gear wheel for ratcheting in a second direction opposite to the first ratcheting direction when the pawl is in the second ratcheting position.

2. The ratcheting tool as claimed in claim 1, with the head further including a top face with an opening of a cross sectional size smaller than the compartment, and the first end of the drive member is extended beyond the opening, with the top face located intermediate the engaging groove and the gear wheel.

3. The ratcheting tool as claimed in claim 1, wherein the second end of the drive member is a drive column for releasably engaging with a socket.

4. The ratcheting tool as claimed in claim 1, further comprising:

a ring mounted in the compartment and around the first end of the drive member, wherein the pawl has a radial extending recess in a top thereof and the ring has a radially extending tip piece, with the ring and the tip piece being generally planar, with the tip piece being slideably engaged in the recess of the pawl in a manner that the ring and the pawl are pivotable about the rotational axis of the gear wheel and that the pawl is movable in the radial direction relative to the ring without disengaging from the ring.

5. The ratcheting tool as claimed in claim 4, wherein the reversing plate includes a through-hole, with the head including a top face with a hole, with the ring including a notch, with the gear wheel of the drive member including an annular groove, with the ratcheting tool further comprising a spring having a small pitch, with the spring being extended through the through-hole of the reversing plate, the hole in the top face of the head, and the notch in the ring and retained in the annular groove of the drive member for providing transmission between the reversing plate and the pawl.

6. The ratcheting tool as claimed in claim 5, wherein the notch of the ring is defined in an inner periphery of the ring.

7. The ratcheting tool as claimed in claim 5, wherein the notch of the ring is defined in an outer periphery of the ring.

8. The ratcheting tool as claimed in claim 1, wherein the reversing plate has a thumb piece projected therefrom for manual operation.

9. The ratcheting tool as claimed in claim 1, wherein the reversing plate includes a receptacle, the reversing plate including an arcuate groove communicated with the receptacle, a pin being securely mounted in the, arcuate groove in a manner allowing pivotable movement of the reversing plate about the rotational axis of the gear wheel.

10. The ratcheting tool as claimed in claim 9, further comprising:

a U-shape slide piece with two limbs;

and an elastic member mounted between the limbs of the slide piece, the slide piece including a tapered push-face consisting of two faces separated by a tip, the push-face of the slide piece being extended into the arcuate groove of the reversing plate, wherein one of the faces bears against the pin when the reversing plate is in its first position to thereby retain the pawl in its first ratcheting position, and wherein the other face of the slide piece bears against the pin when the reversing plate is in its second position to thereby retain the pawl in its second ratcheting position, the slide piece being slidable relative to the elastic member and biased toward the pin by the elastic member.

11. The ratcheting tool as claimed in claim 1, wherein the reversing plate has a recessed portion in an upper side thereof for receiving the C-clip.

12. The ratcheting tool as claimed in claim 11, wherein the recessed portion of the reversing plate has a protrusion and the C-clip has a bulge with a cavity for engaging with the protrusion.

13. The ratcheting tool as claimed in claim 12, wherein the reversing plate has a thumb piece projected therefrom for manual operation.

14. The ratcheting tool as claimed in claim 12, wherein the reversing plate includes a receptacle, the reversing plate including an arcuate groove communicated with the receptacle, a pin being securely mounted in the arcuate groove in a manner allowing pivotable movement of the reversing plate about the rotational axis of the gear wheel.

15. The ratcheting tool as claimed in claim 14, further comprising:

a U-shape slide piece with two limbs; and an elastic member mounted between the limbs of the slide piece, the slide piece including a tapered push-face consisting of two faces separated by a tip, the push-face of the slide piece being extended into the arcuate groove of the reversing plate, wherein one of the faces bears against the pin when the reversing plate is in its first position to thereby retain the pawl in its first ratcheting position, and wherein the other face of the slide piece bears against the pin when the reversing plate is in its second position to thereby retain the pawl in its second ratcheting position, the slide piece being slidable relative to the elastic member and biased toward the pin by the elastic member.

16. The ratcheting tool as claimed in claim 15, further comprising:

a ring mounted in the compartment and around the first end of the drive member, with the ring and the pawl being pivotable about the rotational axis of the gear wheel and the pawl being movable in the radial direction relative to the drive member, wherein the reversing plate includes a through-hole, the head including a top face with a hole, the ring including a notch, the gear wheel of the drive member including an annular groove; and a spring having a small pitch, with the spring being extended through the through-hole of the reversing plate, the hole in the top face of the head, and the notch in the ring and retained in the annular groove of the drive member and providing transmission between the reversing plate and the pawl.

17. A ratcheting tool comprising:

a handle;

a head extended from the handle and having a compartment therein;

a drive member including a first end, a second end, and a gear wheel formed between the first end and the second end, the gear wheel being rotatably mounted in the compartment and including an outer periphery with a plurality of first teeth;

a pawl mounted in the compartment and including a first side with a plurality of second teeth facing the first teeth of the gear wheel and a second side facing away from the gear wheel;

a reversing plate mounted to the first end of the drive member and pivotable about the rotational axis of the gear wheel between a first position and a second position, with the reversing plate including a receptacle and an arcuate groove communicated with the receptacle;

with pivotable movement of the reversing plate between the first position and the second position being transmitted to the pawl for moving the pawl between a first ratcheting position and a second ratcheting position, wherein the second teeth of the pawl are engaged with the first teeth of the gear wheel for ratcheting in a first direction when the pawl is in the first ratcheting position, and wherein the second teeth of the pawl are engaged with the first teeth of the gear wheel for ratcheting in a second direction opposite to the first ratcheting direction when the pawl is in the second ratcheting position;

a pin securely mounted to the head and extending in the arcuate groove in a manner allowing pivotable movement of the reversing plate about the rotational axis of the gear wheel; and a slide piece received in the receptacle and bearing against the pin to thereby retain the reversing plate in one of the first position and the second position.

18. The ratcheting tool as claimed in claim 17, further comprising:

an elastic member, with the slide piece being U-shaped and including two limbs, with the elastic member mounted between the limbs of the slide piece, with the slide piece including a tapered push-face consisting of two faces separated by a tip, with the push-face of the slide piece being extended into the arcuate groove of the reversing plate, wherein one of the faces bears against the pin when the reversing plate is in its first position to thereby retain the pawl in its first ratcheting position, and wherein the other face of the slide piece bears against the pin when the reversing plate is in its second position to thereby retain the pawl in its second ratcheting position, with the slide piece being slidable relative to the elastic member and biased toward the pin by the elastic member.

19. The ratcheting tool as claimed in claim 17, further comprising:

a ring mounted in the compartment and around the first end of the drive member, with the ring and the pawl being pivotable about the rotational axis of the gear wheel and the pawl being movable in the radial direction relative to the drive member, wherein the reversing plate includes a through-hole, with the head including a top face with a hole, with the ring including a notch, with the gear wheel of the drive member including an annular groove; and a spring having a small pitch, with the spring being extended through the through-hole of the reversing plate, the hole in the top face of the head, and the notch in the ring and retained in the annular groove of the drive member and providing transmission between the reversing plate and the pawl.

20. The ratcheting tool as claimed in claim 19, with the tip piece radially extending from the ring, with the ring and the tip piece being generally planar, with the tip piece being slideably engaged in the recess so that the pawl is movable in the radial direction relative to the ring without disengaging from the ring.

21. A ratcheting tool comprising:

a handle;

a head extended from the handle and having a compartment therein;

a drive member including a first end, a second ends and a gear wheel formed between the first end and the second end, with the gear wheel being rotatably mounted in the compartment and including an outer periphery with a plurality of first teeth;

a pawl mounted in the compartment and including a first side with a plurality of second teeth facing the first teeth of the gear wheel, a second side facing away from the gear wheel and a radial extending recess in a top thereof; and a ring mounted in the compartment and around the first end of the drive member, with the ring having a radially extending tip piece, with the ring and the tip piece being generally planar, with the tip piece being slideably engaged in the recess of the pawl in a manner that the ring and the pawl are pivotable about the rotational axis of the gear wheel and that the pawl is movable in the radial direction relative to the ring without disengaging from the ring, with pivotable movement of the ring moving the pawl between a first ratcheting position and a second ratcheting position, wherein the second teeth of the pawl are engaged with the first teeth of the gear wheel for ratcheting in a first direction when the pawl is in the first ratcheting position, and wherein the second teeth of the pawl are engaged with the first teeth of the gear wheel for ratcheting in a second direction opposite to the first ratcheting direction when the pawl is in the second ratcheting position.

22. The ratcheting tool as claimed in claim 21, further comprising:

a reversing plate including a hole so as to be pivotally mounted to the first end of the drive member and pivotable about the rotational axis of the gear wheel between a first position and a second position, with the reversing plate including a through-hole, with the head including a top face with a hole, with the ring including a notch, with the gear wheel of the drive member including an annular groove; and a spring having a small pitch, with the spring being extended through the through-hole of the reversing plate, the hole in the top face of the head, and the notch in the ring and retained in the annular groove of the drive member and providing transmission between the reversing plate and the pawl.

23. The ratcheting tool as claimed in claim 22, further comprising:

a C-clip, with the first end of the drive member including an engaging groove, with the C-clip engaged in the engaging groove for retaining the drive member in place, with the reversing plate having a protrusion, with the C-clip having a cavity for engaging with the protrusion.

24. A ratcheting tool comprising:

a handle;

a head extended from the handle and having a compartment therein and a top face with an opening and a hole;

a drive member including a first end extended beyond the opening, a second end, and a gear wheel formed between the first end and the second end, with the gear wheel being rotatably mounted in the compartment and including an outer periphery with a plurality of first teeth, with the drive member including an annular groove;

a pawl mounted in the compartment and including a first side with a plurality of second teeth facing the first teeth of the gear wheel;

a ring mounted in the compartment and around the first end of the drive member, with the ring and the pawl being pivotable together about the rotational axis of the gear wheel and the pawl being movable in the radial direction relative to the drive member, with the ring including a notch;

a reversing plate including a hole so as to be pivotally mounted to the first end of the drive member and pivotable about the rotational axis of the gear wheel between a first position and a second position, with the reversing plate including a through-hole; and a spring having a small pitch, with the spring being extended through the through-hole of the reversing plate, the hole in the top face of the head, and the notch in the ring and retained in the annular groove of the drive member and providing transmission between the reversing plate and the pawl, with pivotable movement of the reversing plate between the first position and the second position being transmitted to the pawl for moving the pawl between a first ratcheting position and a second ratcheting position, wherein the second teeth of the pawl are engaged with the first teeth of the gear wheel for ratcheting in a first direction when the pawl is in the first ratcheting position, and wherein the second teeth of the pawl are engaged with the first teeth of the gear wheel for ratcheting in a second direction opposite to the first ratcheting direction when the pawl is in the second ratcheting position.

* * * * *